US007025021B1

(12) United States Patent
Andersson et al.

(10) Patent No.: US 7,025,021 B1
(45) Date of Patent: Apr. 11, 2006

(54) TWO-STROKE INTERNAL COMBUSTION ENGINE

(75) Inventors: Lars Andersson, Västra Frölunda (SE); Göran Dahlberg, Gränna (SE); Bo Jonsson, Habo (SE); Hans Ström, Kode (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 09/483,478

(22) Filed: May 30, 2000

(30) Foreign Application Priority Data

Jan. 19, 1999 (SE) ..... 9900138

(51) Int. Cl.
*F02B 33/00* (2006.01)

(52) U.S. Cl. ..... 123/73 PP; 123/73 C; 123/65 W; 123/73 FA

(58) Field of Classification Search ..... 123/73 R, 123/73 A, 73 AA, 73 C, 73 FA, 73 PP, 74 AP, 123/65 A, 65 P
See application file for complete search history.

(56) References Cited

U.S. PATENT DOCUMENTS

| | | | | |
|---|---|---|---|---|
| 968,200 | A | 8/1910 | Scott | |
| 980,134 | A | 12/1910 | Springer | |
| 1,113,456 | A | 10/1914 | McIntosh | |
| 1,121,584 | A | 12/1914 | Harper, Jr. | |
| 2,317,772 | A | 4/1943 | Huber et al. | |
| 3,916,851 | A | 11/1975 | Otani | |
| 4,067,302 | A | 1/1978 | Ehrlich | |
| 4,075,985 | A * | 2/1978 | Iwai | 123/73 A |
| 4,084,556 | A | 4/1978 | Villella | |
| 4,176,631 | A | 12/1979 | Kanao | |
| 4,248,185 | A | 2/1981 | Jaulmes | |
| 4,253,433 | A | 3/1981 | Blair | |
| 4,306,522 | A | 12/1981 | Fotsch | |
| 4,340,016 | A | 7/1982 | Ehrlich | |
| 4,478,180 | A | 10/1984 | Fujikawa et al. | |

(Continued)

FOREIGN PATENT DOCUMENTS

AT 394755 B 11/199

(Continued)

OTHER PUBLICATIONS

Prof.Dr.H.P.Lenz, Dipl.Ing.G.Bruner, Dipl.Ing. F. Gerstl, Abschussbericht, zum Forschungsauftrag sur Entwicklung eines Ladungswechselverfahrens mit Spülvorlage für Motorfahrräder, Mar. 1978, pp. 1–16, Tables I–III, Bild 1–17, Z–NR. B0644, Institut Für Verbrennungskraftmaschinen Und Kraftfahrewsen. Technische Universität Wien.

(Continued)

*Primary Examiner*—Marguerite McMahon
(74) *Attorney, Agent, or Firm*—Novak Druce & Quigg, LLP

(57) ABSTRACT

Crankcase scavenged two-stroke internal combustion engine (1), in which a piston ported air passage is arranged between an air inlet (2) and the upper part of a number of transfer ducts (3, 3'). The air inlet is equipped with a restriction valve (4), controlled by at least one engine parameter, for instance the carburettor throttle control. The air inlet extends via at least one connecting duct (6, 6') to at least one connecting port (7, 7') in the engine's cylinder wall (12). The connecting port (7, 7') is arranged so that it in connection with piston positions at the top dead center is connected with flow paths (9, 9') embodied in the piston (13), which extend to the upper part of a number of transfer ducts (3, 3'), and the flow paths in the piston are so arranged that the recess (10, 10'; 11, 11') in the piston that meets the respective transfer duct's port (31, 31') is so arranged that the air supply is given an essentially equally long or longer period, counted as crank angle or time, in relation to the fuel and air mixture inlet period.

50 Claims, 4 Drawing Sheets

U.S. PATENT DOCUMENTS

| | | | | | |
|---|---|---|---|---|---|
| 4,481,910 | A | | 11/1984 | Sheaffer | |
| 4,969,425 | A | * | 11/1990 | Slee | 123/73 AA |
| 4,987,864 | A | | 1/1991 | Cantrell et al. | |
| 5,163,388 | A | | 11/1992 | Jonsson | |
| 5,379,732 | A | * | 1/1995 | Mavinahally et al. | 123/73 PP |
| 5,425,346 | A | | 6/1995 | Mavinahally | |
| 5,447,129 | A | | 9/1995 | Kawasaki et al. | |
| 5,645,026 | A | * | 7/1997 | Schlessmann | 123/73 C |
| 5,678,525 | A | | 10/1997 | Taue | |
| 5,727,506 | A | | 3/1998 | Tajima et al. | |
| 5,857,450 | A | * | 1/1999 | Staerzl | 123/73 PP |
| 5,992,375 | A | | 11/1999 | Nagashima | |
| 6,016,776 | A | | 1/2000 | Jonsson | |
| 6,085,703 | A | | 7/2000 | Noguchi | |
| 6,112,708 | A | | 9/2000 | Sawada et al. | |
| 6,216,650 | B1 | | 4/2001 | Noguchi | |
| 6,240,886 | B1 | | 6/2001 | Noguchi | |
| 6,289,856 | B1 | | 9/2001 | Noguchi | |

FOREIGN PATENT DOCUMENTS

| | | | |
|---|---|---|---|
| DE | 420100 | | 10/1925 |
| DE | 470603 | | 1/1929 |
| DE | 748415 | | 11/1944 |
| DE | 749456 | | 11/1944 |
| DE | 2 151 941 | | 4/1973 |
| DE | 26 50 834 | | 6/1977 |
| DE | 3329791 | A1 | 2/1985 |
| DE | 37 22 424 | | 1/1988 |
| DE | 19520944 | | 1/1996 |
| DE | 19857738 | A1 | 7/1999 |
| EP | 0 337 768 | | 10/1989 |
| EP | 0 391 793 | | 10/1990 |
| EP | 0971110 | A1 | 1/2000 |
| EP | 0997620 | A2 | 5/2000 |
| FR | 784.866 | | 7/1935 |
| FR | 1434710 | | 5/1965 |
| GB | 2 022 699 | | 5/1979 |
| GB | 2 130 642 | | 7/1983 |
| JP | 585423 | | 1/1983 |
| JP | 585424 | | 1/1983 |
| JP | 58-005423 | | 1/1983 |
| JP | 58005424 | | 1/1983 |
| JP | 57-183520 | A | 11/1989 |
| JP | 144740 | | 12/1989 |
| JP | 426657 | | 6/1992 |
| JP | 7139358 | | 5/1995 |
| JP | 07269356 | | 10/1995 |
| JP | 9125966 | | 5/1997 |
| JP | 10252565 | | 9/1998 |
| JP | 2000170611 | | 6/2000 |
| JP | 2000328945 | | 11/2000 |
| JP | 2000337154 | | 12/2000 |
| WO | WO 89 02031 | A1 | 3/1989 |
| WO | WO 00/43650 | A1 | 1/2000 |
| WO | WO 00 65209 | A1 | 11/2000 |
| WO | WO 01 25604 | A1 | 4/2001 |
| WO | WO 01 44634 | A1 | 6/2001 |

OTHER PUBLICATIONS

Dipl.Ing. Freidrich Gerstl, Dissertation, Massnahmen Zur Abgas—Und Verbrauchsverbesserung Von Kleimvolumigen Zweitakt—Ottomotoren, ausgefuhrt sum Zwecke, der Erlangung des akademischen Grades eines Doktors der technischen Wissenschaften, eingereicht an der Technischen Universitat in Wein, Aug. 1979.

J. Meyer, Air–Head Charge Stratification Of A Two–Stroke Outboard Engine, Mar. 1992, The Queen's University of Belfast, School of Mechanical & Manufacturing Engineering.

Dr. R. Pischinger, 5$^{TH}$ Graz Two–Wheeler Symposium, Apr. 22–23, 1993, Heft 65, Technische Universitat Graz, Mitteilungen des Institutes fur Verbrennungskraftmaschinen und Thermodynamik, Belfast, Ireland.

Patent Abstracts of Japan, Crank Chamber Compression 2–Cycle Internal Combustion Engine, appl. No. 56102519, appl. date Jun. 1981.

Patent Abstract of Japan, Device for Preventing Mixture from Blowing Through Two–Cycle Engine, appl. No. 56–69216, appl. date Jun. 1981.

WO98/57053, Stratified Scavenging Two–Cycle Engine, Dec. 1998.

Blume, K., Zweitakt–Gemischpülung mit Spülvorlage. IN: MTZ Motortechnische Zietschrift 74 (1972), pp. 475–479.

Lanchester, FW and Pearsall RH, The Institution of Automobile Engineers, An Investigation of Certain Aspects of the Two–Stroke Engine for Automobile Vehicles. IN: The Automobile Engineer, Feb. 1922, pp. 55–62.

* cited by examiner

TWO-STROKE INTERNAL COMBUSTION ENGINE

TECHNICAL FIELD

The subject invention refers to a two-stroke crankcase scavenged internal combustion engine, in which a piston ported air passage is arranged between an air inlet and the upper part of a number of transfer ducts. Fresh air is added at the top of the transfer ducts and is intended to serve as a buffer against the air/fuel mixture below. This buffer is mainly lost out into the exhaust outlet during the scavenging process; fuel consumption and exhaust emissions are thereby reduced. The engine is especially well suited for incorporation in handheld working tools.

BACKGROUND OF THE INVENTION

Combustion engines of the above mentioned type are known. They reduce fuel consumption and exhaust emissions, but it is difficult to control the air/fuel ratio in such an engine. U.S. Pat. No. 4,075,985 shows an example of a two-stroke engine where air ducts connect to the upper part of the engine's transfer ducts. Check valves are arranged at the connection between the ducts. A restriction valve is arranged in the air supply system to the transfer ducts. This is mechanically connected to the throttle valve of the carburetor of the engine, so that the two valves are following each other.

U.S. Pat. No. 5,425,346 shows an engine with a somewhat different design than that described above. In the '346 patent, channels are arranged in the piston of the engine which at specific piston positions are aligned with ducts arranged in the cylinder. Fresh air, as shown in FIG. 7, or exhaust gases can thereby be added to the upper part of the transfer ducts. This only happens at the specific piston positions where the ducts in the piston and the cylinder are aligned. This happens both when the piston moves downwards and when the piston moves upwards, but far away from the top dead center position. To avoid unwanted flow in the wrong direction in the latter case, check valves are arranged at the inlet to the upper part of the transfer ducts. In this respect it consequently corresponds to the previously mentioned patent. These type of check valves, usually called reed valves, have a number of disadvantages. They frequently have a tendency to come into resonant oscillations and can have difficulties coping with the high rotational speeds that many two-stroke engines can reach. Besides, it results in added cost and an increased number of engine components. Should such a valve break into smaller pieces, the pieces can enter into the engine and cause severe damages. The amount of fresh air added is, for the solution according to the '346 patent, varied by means of a variable inlet, i.e. an inlet that can be advanced or retarded in the work cycle. This is, however, a very complicated solution.

The international patent application WO98/57053 shows a few different embodiments of an engine where air is supplied to the transfer ducts via L-shaped or T-shaped recesses in the piston. Thus, there are no check valves. In all embodiments, the piston recess has, where it meets the respective transfer duct, a very limited height, which is essentially equal to the height of the actual transfer port. A consequence of this embodiment is that the passage for the air delivery through the piston to the transfer port is opened by the piston significantly later than is the passage for the air/fuel mixture to the crankcase. The period for the air supply is consequently significantly shorter than the period for the supply of air/fuel mixture, where the period can be counted as crank angle or be measured in time. This means that the amount of air that can be delivered to the transfer duct is significantly limited since the underpressure driving this additional air has significantly decreased because the inlet port has already been open during a certain period of time when the air supply is opened. This implies that both the period and the driving force for the air supply are small. Furthermore, the flow restriction in the L-shaped and the T-shaped ducts becomes relatively high. This is partly because the cross section of the duct is small close to the transfer port and partly because of the abrupt bend created by the L-shape or T-shape. In all, this contributes to reducing the amount of air that can be delivered to the transfer ducts which in turn reduces the possibilities to reduce the fuel consumption and the exhaust emissions by means of this arrangement.

SUMMARY OF THE INVENTION

A combustion engine configured in accordance with the present invention is at least partially characterized in that an air passage is arranged from an air inlet equipped with a restriction valve that is controlled by at least one engine parameter, such as the carburettor throttle control. The mentioned air inlet is provided via at least one connecting duct channelled to at least one connecting port in the cylinder wall of the engine, which is arranged so that it, in connection with piston positions in a top dead center configuration, is connected with flow paths embodied in the piston. The flow paths extend to the upper part of a number of transfer ducts, and the flow paths in the piston are arranged so that the recess in the piston that meets the respective transfer duct's port is configured so that the air supply is given an essentially equally long or longer period, counted as crank angle or time period, in relation to the fuel and air inlet mixture.

Because at least one connecting port in the engine's cylinder wall is arranged so that it, in connection with piston positions in a top dead center configuation, is connected with flow paths embodied in the piston so that a supply of fresh air to the upper part of the transfer ducts can be arranged entirely without check valves. This can take place because at piston positions at or near a top dead center position, there is an underpressure in the transfer duct in relation to the ambient air. As a result, piston ported air passages without check valves can be arranged which is a major advantage. Because the air supply has a very long period, a lot of air can be delivered so that a very high exhaust emissions reduction effect can be achieved. Control is applied by means of a restriction valve in the air inlet that is controlled by at least one engine parameter. Such control is a significantly less complicated design than a variable inlet. The air inlet has preferably two connecting ports, which in one embodiment are located so that the piston is covering them at its bottom dead center position. The restriction valve can suitably be controlled by the engine speed alone or in combination with another engine parameter. These and other characteristics and advantages are clarified in the detailed description of the different embodiments of the presently disclosed invention and which is supported by the enclosed drawing figures.

BRIEF DESCRIPTION OF THE DRAWING

The invention will be described in greater detail in the following by means of various embodiments thereof with reference to the accompanying drawing figures. For parts that are symmetrically located on the engine, the part on the one side has been given a numeric designation while the part on the opposite side has been given the same designation but with a prime (') symbol.

DESCRIPTION OF THE EMBODIMENTS

Figure 1:
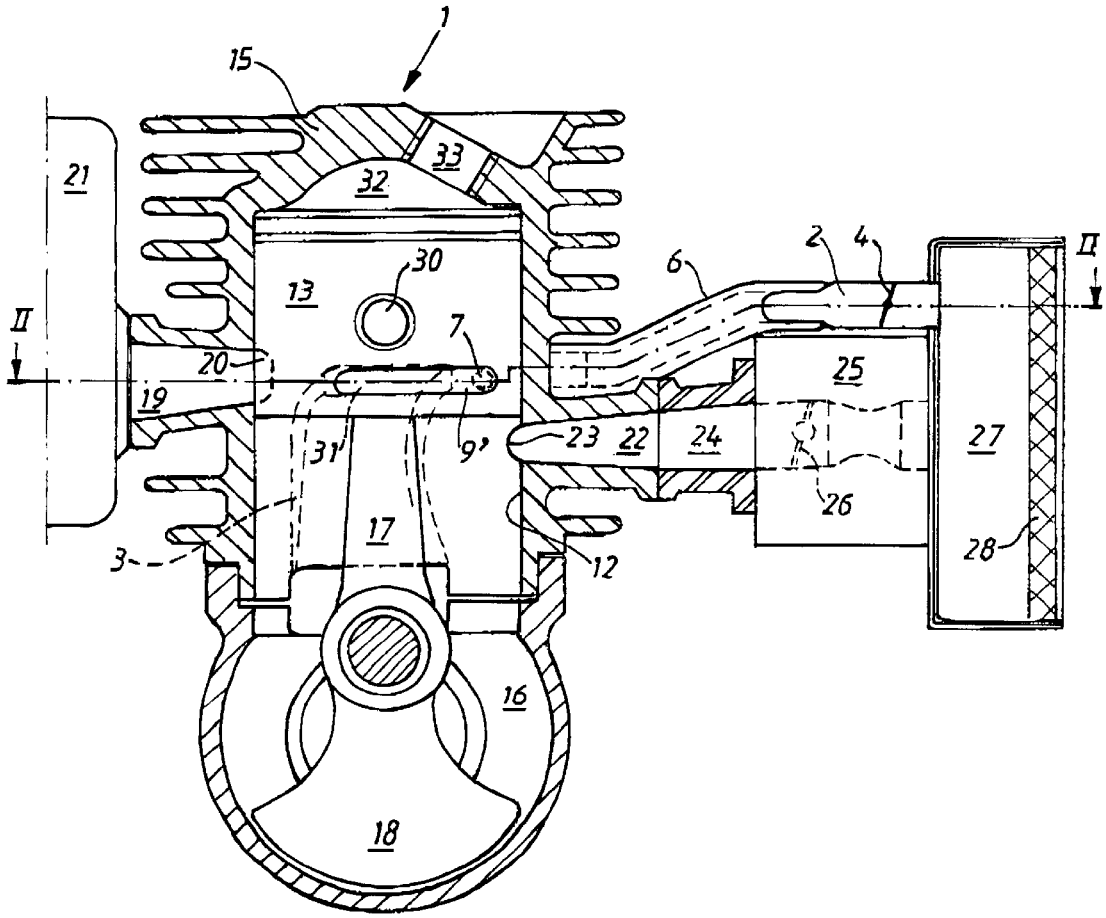
FIG. 1 shows a side view of one embodiment of the subject invention. The cylinder is shown in cross section, while the piston, from a clarity point of view, is not shown in cross section, but is shown in a top dead center configuration.

In FIG. 1, reference numeral 1 designates an internal combustion engine configured according to the present invention. It is of two-stroke type and has transfer or scavenging ducts 3, 3'. The latter is not visible since it is located above the plane of the paper. It is however shown in FIG. 2. The engine 1 has a cylinder 15, a crankcase 16, a piston 13 with a connecting rod 17 and a crank mechanism 18. Furthermore, the engine 1 has an exhaust outlet 19, that has an exhaust port 20 and that ends in a muffler 21. Furthermore, the engine 1 has a fuel and air inlet tube 22 with a fuel and air inlet port 23. The inlet tube is connected to an intermediate section 24, which in turn connects to a carburetor 25 with a throttle valve 26. The carburetor 25 connects to an inlet muffler 27 with a filter 28. The piston 13 is connected to the connecting rod 17 by means of a piston pin 30. The piston 13 also has a plane upper side without any recesses or other adaptations on its top surface, so that it co-operates equally with the cylinder ports wherever they are located around the periphery. The height of the power head is therefore approximately unchanged in comparison with a conventional engine. The transfer or scavenging ducts 3 and 3' terminate in scavenging ports 31 and 31' in the engine's cylinder wall 12. The engine has a combustion chamber 32 with an attachment point 33 for a spark plug, which is not shown.

One special aspect is that an air inlet 2 equipped with a restriction valve 4 is provided so that fresh air can be supplied to the cylinder. The air inlet 2 is divided into two branches referred to as connecting ducts 6 and 6'. These are channelled to the cylinder, which is equipped with connecting or air inlet ports 7, 7'. These connecting ports 7, 7' are shaped as a cylindrical hole, each with a fitted connecting nipple 34, 34'. In the context of the present disclosure, the terminology of connecting port is utilized to identify connections on the inside of the cylinder, while corresponding ports on the outside of the cylinder are called outer connecting ports. This is clearly shown in FIG. 2 in combination with FIG. 1. The air inlet 2 may be suitably designed as a y-shaped tube, while the connecting ducts, for example, are suitably made of rubber hoses. The air inlet 2 suitably connects to the inlet muffler 27 so that cleaned fresh air is taken in. If the requirements are lower, this is of course not necessary.

Figure 2:
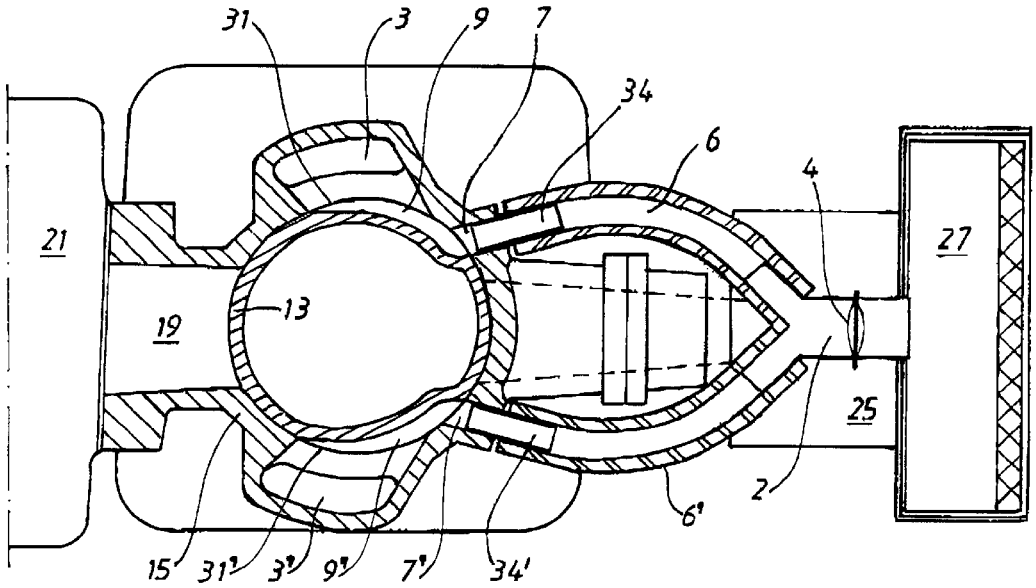
FIG. 2 shows the engine according to FIG. 1 in cross section taken along line 2—2. This is consequently a cross section shown from above through the engine's exhaust outlet, transfer duct's ports and through the entire air inlet.

Flow paths 9, 9' are arranged in the piston 13 so that they, when the piston is in a top dead center configuration, connect the respective connecting or air inlet port 7, 7' to the upper part of the transfer or scavenging ducts 3, 3'. The flow paths 9, 9' may be configured as local recesses in the piston 13. As shown in FIG. 2, the piston 13 is simply manufactured, usually cast, with these local recesses. As illustrated in FIG. 1, there is a small height difference between the vertical positions of the connecting or air inlet port 7 at the inside and the outside of the cylinder. This is of course possible, but unnecessary and in some cases unsuitable since the distance between the connecting ducts 6 and 6' is so large that there is no interference from the inlet tube 22. Thus they can be located entirely to the side of the inlet tube, if applicable. The level difference in FIG. 1 is entirely explained by the fact that it is easier to clearly visualize the connecting duct 6 if completely above the fuel and air mixture inlet tube 22. The air inlet 2 suitably has at least two connecting or air inlet ports 7, 7' in the engine's cylinder wall 12. Another advantage is that the recesses in the piston can be made smaller with respect to sideways dimensions. Alternatively, it is indeed possible to have only one connection or air inlet duct. This should then be entered either above or below the fuel and air inlet tube 22 or below the exhaust outlet 19. To obtain the desired vertical position for the corresponding connecting or air inlet port 7, an oblique passage through the cylinder wall would probably have to be arranged. In this case, only one connecting or air inlet duct and only one corresponding outer connecting port would be required, but this would otherwise result in a number of disadvantages. The sideways positioning of the two connecting or air inlet ports 7, 7' in relation to the respective transfer or scavenging ducts 3, 3' can be varied considerably. They can for instance be drawn closer to the transfer duct so that the relative distance between the connecting ducts 6, 6' is increased. In that way the size of the recesses can be somewhat reduced. The connecting ports 7, 7' can also be located on opposite sides of the respective transfer ducts; that is, between the transfer duct and the exhaust outlet 19. It is of course also possible to place connecting ports on both sides of the respective transfer ducts. This becomes more complicated and implies in total four connecting ducts, but would accommodate the supply of larger amounts of air. To obtain a satisfactory result from an emissions and fuel consumption point of view, it is important that the fresh air is delivered with a minimum of turbulence thereby minimizing the extent to which the fresh air mixes with the fuel and air mixture in the respective transfer duct. The purpose is, as mentioned, that the fresh air shall act as a buffer which depresses the air/fuel mixture so that subsequently the fresh air is lost out into the exhaust port instead of the air/fuel mixture. The solution illustrated in FIGS. 1 and 2 is, however, in this respect, a hybrid. When the piston 13 is positioned in a bottom dead center configuration, the entire exhaust port 20 is open as well as the scavenging ports 31, 31' of the transfer or scavenging ducts and the connecting or air inlet ports 7, 7' for the fresh air.

Figure 3:
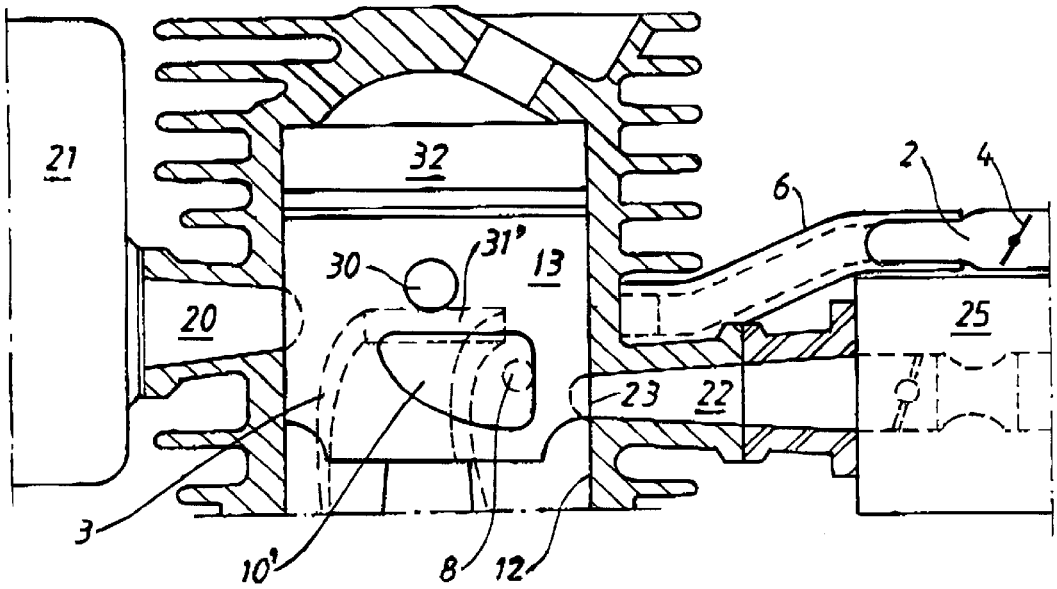
FIG. 3 shows a cross section similar to that in FIG. 1, but of a different embodiment. The piston and the flow paths in the piston and the cylinder are differently designed. The piston is also shown in a position below the top dead center configuration.
Figure 4:
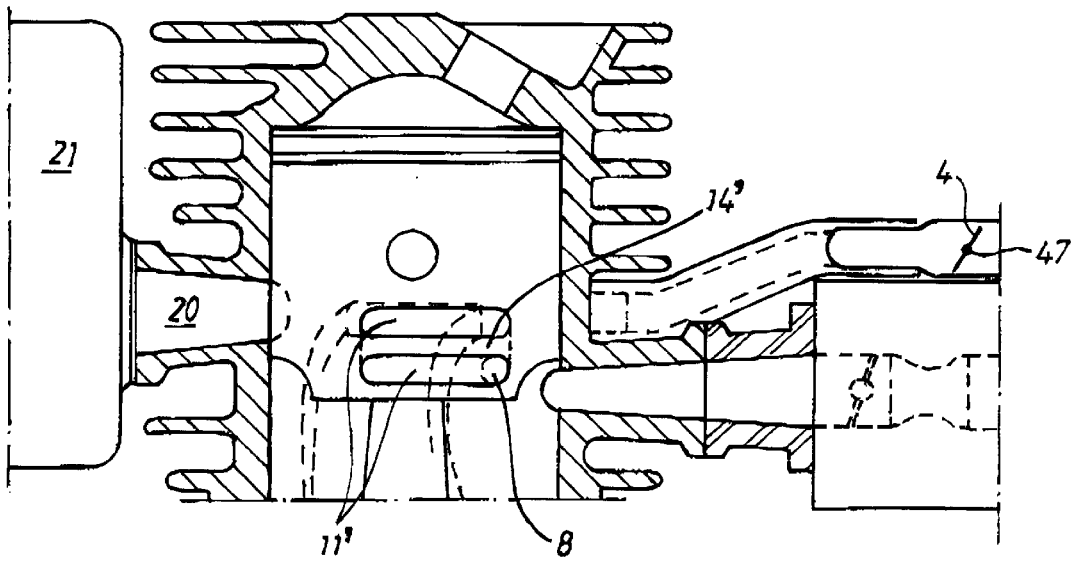
FIG. 4 shows a somewhat different embodiment than that shown in FIG. 3. The flow path in the piston is laid out by means of a duct arranged in the piston. The piston is shown in the top dead center configuration.

This means that exhaust gases can be pressed in through the connecting ports and further on up through the connecting ducts 6, 6', with a possibility of reaching the air inlet 2. This is suitably designed so that a moderate amount of exhaust gas is added to the fresh air. If too much exhaust gas flows upstream, however, the carburetor function may be disturbed and in extreme cases the air filter 28 may of course get dirty from this function. Moderation of the amount of exhaust gas is accomplished by moving the respective connecting ports 7, 7' downwards. Their vertical location determines the period of time available for the exhaust gases to be in contact or fluid communication with the respective connecting ports. In FIGS. 3 and 4, the connecting or air inlet ports 8, 8' have been moved so far down that they do not come in contact with the exhaust gases at all when the piston is at the bottom dead center. Instead, the piston seals off the port 8, 8' so that such a connection does not occur.

When the connecting ports 7, 7' are lowered, the recesses must be given increased height in the longitudinal axial direction of the piston. The recess is obviously intended to be a connection between the connecting or air inlet ports 7, 7' and the respective ports 31, 31' of the transfer or scavenging ducts 3, 3'. This clearly appears from a comparison with FIG. 3. In the embodiment according to FIG. 1, a flow path is created when air inlet port 7 and scavenging port 31 of the transfer or scavenging duct respectively become connected with each other by means of the piston recess as the top dead center configuration of the piston is assumed. The size of the connection between the air inlet and scavenging ducts reaches its maximum at the absolute top dead center piston position, but subsequently reduce as the piston moves away from the top dead center position in the opposite direction. The top dead center configuration includes the series of piston positions approaching and departing the absolute top dead center piston position during which fluid communication is affected across the flow path between the air inlet duct 6, 6' and the scavenging duct 3, 3'. In FIG. 1, fuel and air ports 23 of the fuel and air inlet ducts 22 are opened earlier than the connecting or air inlet port 7 is opened by the recess in the piston 13 coming into registration therewith. Thus, the underpressure in the crankcase starts to be evened out even before the flow path between the air inlet 2 and the transfer or scavenging duct is opened. This results in a limited amount of gases from the air inlet 2 being able to penetrate down into the transfer or scavenging duct 3. The opposite situation prevails in FIG. 3 where the piston 13 is shown in a location a certain distance away from an absolute top dead center position. This piston position is characterised by the fuel and air inlet port 23 not having opened, but about ready to do so. On the contrary, the communication between the air inlet 2 and the transfer ducts 3, 3' has already been opened, and is progressively becoming more open during a subsequent piston movement. The underpressure in the crankcase is consequently at its maximum during this initial opening, and subsequently starts to diminish as the connection between the fuel and air inlet tube 22 and the crankcase 16 is established. In this case, more fresh air from the air inlet 2 can consequently be transported down into the transfer ducts. It is desirable that both of the transfer ducts 3, 3' be entirely filled with such buffer air or gas. On the other hand, it is not desirable that the amount of buffer air be significantly greater than the volume of the transfer duct since it will then only dilute the air/fuel mixture in the crankcase. The air supply has consequently been given a longer period, counted as crank angle or time duration, than the fuel and air inlet. In other illustrated embodiments, the fuel and air mixture inlet period is instead longer. It is often desirable that the fuel and air mixture inlet period and the air period be essentially equally long. Suitably, the air period should be between 90%–110% of the fuel and air mixture inlet period. In FIG. 3, this is achieved by means of an upper edge of the recesses 10, 10', which each meets a respective scavenging port 31, 31' of the transfer ducts 3, 3' being lowered so that the upper recess edge becomes aligned with a lower edge of the transfer or scavenging ports. These periods are obviously both limited by the maximum period during which the crankcase pressure is low enough to enable maximum inward flow. Both periods are preferably maximized and equally long. The location of the upper edge of the recess 10, 10' consequently determines how early the recess gets connected with the respective ports 31, 31' of the transfer ducts. Thus, suitably the variably configured recesses 10, 10'; 11, 11' in the piston, which come into registration with respective ports 31, 31' of the transfer ducts, have, locally at this port, an axial height that is more than 1.5 times the height of the respective transfer or scavenging port, and preferably more than 2 times the scavenging port 31, 31' height. A precondition is that the scavenging ports 31, 31' each have a normal height, so that the upper side of the piston, when at its bottom dead center position is aligned with the lower side of the transfer port or extends upwards across a portion of the ports 31, 31' just a few millimeters. In FIG. 3, the recess 10,10' has a substantially triangular type of shape, which implies that its height at the transfer port varies, which in turn means that the above mentioned relation in this case should be seen as an average. The recess 10, 10' can naturally instead be given a rectangular shape so that its lower edge is aligned with the lower edge of the recess 10, 10'. Its left edge can be aligned with the corresponding edge of the port 31, 31' so that the flow restriction can consequently be somewhat reduced.

The recess is preferably downwards shaped in such a way that the connection between the recess 10, 10' and the connecting or air inlet port 8, 8' is maximized since it reduces the flow resistance. This means that when the piston is located at its top dead center position the recess 10, 10' preferably reaches so far down that it is in complete communication with the connecting port 8, 8,'. If the piston in FIG. 3 is lowered slightly so that the upper edge of the recess 10, 10' aligns with the lower edge of the scavenging port 31, 31', it is evident that the recess 10, 10' at the connecting or air inlet port 8, 8' reaches thereabove by a broad margin. This entails that the connection between the piston recess 10, 10' and the air inlet port 8, 8' starts to open earlier than, and is maximized before the connection between the piston recess and the scavenging port 31, 31' is opened. In this way the sensitivity to various production tolerances is reduced, as well as air flow resistance through the flow path. As a whole, this means that the recesses 10, 10'; 11, 11' in the piston that locally meet each respective connecting port 7, 7'; 8, 8' has an axial height which is greater than 1.5 times the height of the respective air inlet port, but preferably greater than 2 times the height of the port. Thus, in the embodiment according to FIG. 3, the connecting port(s) 8, 8' in the cylinder wall 12 of the engine are located so that the piston 13 covers them when it is located at its bottom dead center position. Consequently, exhaust gases cannot penetrate into the air inlet in this bottom dead center configuration.

The relative location of the connecting or air inlet port 7, 7'; 8, 8' and the transfer duct's port 31, 31', or scavenging port 31, 31', with respect to an axial direction, can be varied considerably, provided that the ports are shifted sideways, i.e. in the cylinder's tangential direction as shown in FIGS. 1, 3 and 4. FIG. 1 illustrates a case where the' connecting port 7, 7' and the scavenging port 31, 31' are located at the same level, while FIGS. 3 and 4 show solutions where the connecting ports are located at a considerably lower level than the scavenging ports 31, 31'. As mentioned, all intermediate locations are plausible. Even when the connecting port(s) is covered by the piston in the bottom dead center position it may be advantageous to have an axial overlap between the connecting port and the scavenging port; that is, the upper edge of each connecting port respectively is located as high or higher in the cylinder's longitudinal axial direction as is the lower edge of each respective scavenging port. One advantage is that the two ports are more aligned with each other in an arrangement of this kind, which reduces the flow resistance when air is being transported from the air inlet port to the scavenging port. Consequently, more air can be transported, which can enhance the positive effects of this arrangement in the form of reduced fuel consumption and reduced exhaust emissions. For many two-stroke engines, the piston's upper side is level with the lower edge of the exhaust outlet and the lower edge of the scavenging port when the piston is at its bottom dead center position. However, it is also quite common for the piston to extend one or a few millimeters above the scavenging port's lower edge. If the lower edge of the scavenging port is further lowered, an even greater axial overlap will be created between the connecting port and scavenging port. When air is supplied to the scavenging duct, the flow resistance is now reduced, both due to that the ports are more level with each other and also due to the greater surface area of the scavenging port.

In the embodiments according to FIGS. 1, 2 and 3, the flow paths in the piston are shaped in the form of recesses in the piston's periphery. However, it is also possible to design the flow paths in the piston in the form of at least one duct 14, 14'. This is evident from FIG. 4. An upper and a lower recess 11' are joined via a duct which runs inside the piston. This becomes more complicated than the solution in accordance with FIG. 3, but may provide a calmer flow of gas or air from the connecting or air inlet port 8' across to the upper part of the corresponding transfer duct 3'. If the upper recess 11, 11', of FIG. 4 which meets the respective transfer duct's port 31, 31', is given a greater height by raising its upper edge axially, the air supply can then be given a period that is as long or longer than the fuel and air inlet. If the duct has full width as illustrated, the embodiment can then be regarded as solely a duct, but the duct can also have a smaller width, and in that case, it would be more suitable to regard it as a duct with two recesses at the piston's surface. Even in the embodiment illustrated in FIGS. 1 and 2, the communication can take place in the form of a duct or for instance a recess and a duct, or two recesses and a duct. It can be especially interesting to use combinations with one duct through the piston when only one single connecting port 6 is used. Thus, for each of the illustrated embodiments the flow paths are at least in part carried out in the form of a recess in the piston's periphery, or in the form of a duct inside the piston. In the embodiment according to FIG. 4, the connecting port 8, 8' is located lower than the exhaust port 20. Thereby, the piston affects a seal when in its bottom dead center position so that exhaust gases cannot penetrate in through the connecting port.

Figure 5:
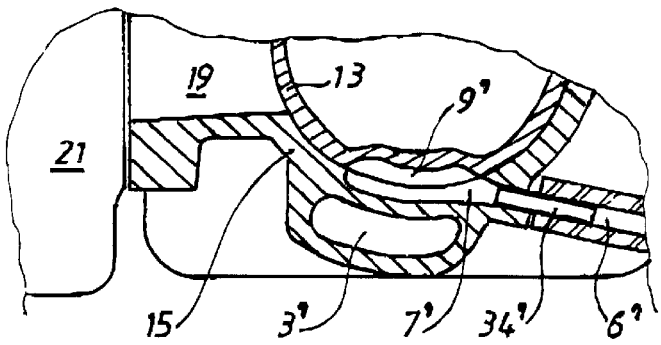
FIG. 5 shows a cross section through the piston and the cylinder through a connecting port for air to the transfer duct.

FIG. 5 illustrates an especially interesting positioning of the connecting port 7, 7'. It is located essentially inside an adjacent transfer duct 3, 3' so that the connecting port essentially debouches under the transfer duct's port 31, 31'. Since the connecting port uses the space inside the transfer duct, the recess 10, 10' and/or the duct 14, 14' can be made particularly narrow in the sideways direction, which is an advantage.

What the illustrated embodiments have in common is that the flow path from the air inlet 2 to the upper part of the transfer duct 3, 3' is carried out entirely without a check valve. This is, as already mentioned, a great advantage, but at the same time it is naturally possible to use a check valve in special embodiments. The invention has been exemplified with an engine with two transfer ducts 3, 3', but naturally it can also have a different number of ducts, for instance four, which is common. Five ducts or even one duct is of course also plausible. Normally the flow paths in the piston shall extend to the upper part of all of the transfer ducts in the different embodiment examples. However, it is also possible that the flow paths only extend to the transfer ducts which are located closest to the exhaust outlet 19. The flow paths, which have been illustrated in the various embodiment examples, are primarily intended for the stated purpose. However, the favorable duct locations, as illustrated, are naturally also useful for kindred purposes. One example of this can be that the air inlet 2, the connecting ducts 6 and the flow paths in the piston are instead used for adding cooled exhaust gases to the upper part of the transfer ducts. Another example is that certain transfer ducts are supplied with a rich mixture.

Figure 6:
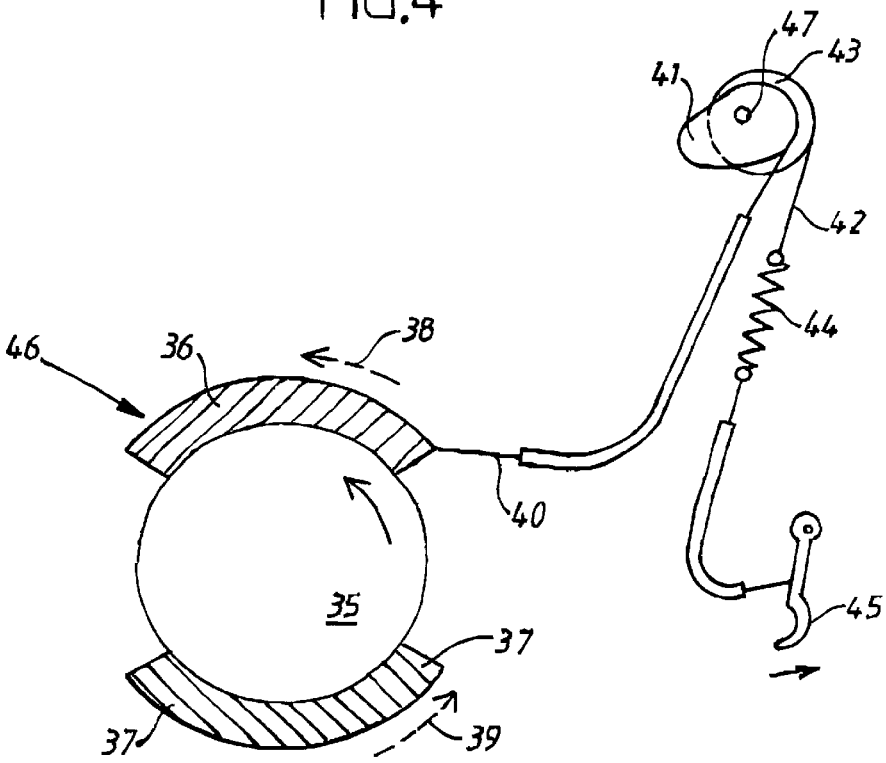
FIG. 6 schematically shows a control device for a restriction valve, that for clarity purposes, is shown located far below the real functional location.

One challenge in connection with the usage of the above described design can be to control the air/fuel ratio of the engine. This is suitably carried out by means of a restriction valve 4. At idling, the valve 4 shall be completely or almost completely closed and then open at higher engine speeds. The transition can occur suddenly by means of the valve snapping over or opening gradually more and more. The latter function can be achieved by joining the throttle valve 26 and the restriction valve 4. In this case, the restriction valve 4 is solely guided by the throttle valve position. It has, however, been found that engine load variations tend to result in unacceptable variations in the air/fuel ratio. This problem can be avoided by letting the restriction valve 4 be controlled by the engine speed so that the valve is essentially closed at idling and then opened at engine speeds above a specified, low engine speed. A solution of this type is illustrated schematically in FIG. 6. The figure also shows that the restriction valve is controlled by at least one additional engine parameter, apart from the engine speed. In the illustrated case, the additional engine parameter is the throttle valve position. However, the additional parameter can also be the underpressure in the engine's fuel and air inlet tube. An engine speed dependent torque or force transducer 46 can be arranged in a number of different ways, but is shown here relatively schematically. The engine speed dependent transducer 46 consists of, together with the crankshaft, a rotating disc or cup 35 made of aluminium or similar material for instance the flywheel. One or two segments 36, 37, equipped with permanent magnets, can be turned in the direction of rotation in accordance with arrow 38 or 39 respectively against a spring force. The two segments can be separately movable, or joined so that they turn together, essentially around the rotational center of the disc or the cup 35. A cable 40 is attached to the segment 36 at one end and influences the restriction valve 4 with its other end. A pulley 41 with a variable unrolling radius is mounted to the shaft 47 of the restriction valve 4. The system allows substantial variation possibilities for the opening, closing and restricting functions of the valve. Naturally, the cable can also act directly on a simple lever instead of the pulley 41, if these variation possibilities are not wanted. The restriction valve 4 is suitably closed or almost closed at idling, and will start opening at a specified engine speed thereabove. Suitably, the opening takes place gradually. The valve can possibly also over-rotate so that it starts throttling at overspeeds; that is, it rotates further than the point at which it gives the least possible flow resistance in the air inlet 2. The restriction valve 4 could hereby also act as a protection against overspeeding by means of enriching the air/fuel mixture. This engine speed dependent control can also be combined with a control that is dependent on the throttle valve position. In this case, the cable 42 is attached either to a pulley 43 or a lever attached to the shaft of the restriction valve 4. The other end of the cable is attached to the throttle linkage 45 via a tensile spring 44. Thus, by means of the cable 40, the restriction valve 4 is influenced by an engine speed dependent, rotational force and, via the cable 42, by a throttle valve position dependent, cooperative, rotational force. In other words, the restriction valve 4 is in a torque equilibrium between the mentioned, rotational torques and the torque from a return spring; that is, a force equilibrium system. Alternatively, one could consider a position defined system, where a speed controlled, electric control device turns the restriction valve 4 on its own, or in combination with a linkage connected to the throttle valve position. If an electric control device is used, it will naturally have to be supplied with power from the engine itself, while the illustrated engine speed dependent transducer 46 is self-supporting and in that respect simpler. If an electric control device is used, it is easy to detect different, suitable engine parameters, even underpressure in the inlet tube, and feed these into a micro computer, from which to give signals for suitable maneuvering of the restriction valve 4.

The restriction valve 4 can also be controlled by the underpressure which prevails in the engine's inlet tube, so that the valve is essentially closed at idling, to be opened at an underpressure less than a specified underpressure. The underpressure in the engine's inlet tube can affect a small cylinder, which by itself or via an intermediate element influences the restriction valve 4. In a corresponding way, as in the example given above concerning the engine speed and the throttle valve position, the control of the underpressure can also be weighed together with an additional engine parameter, such as the throttle valve position and the engine speed.

The different methods, as described above, to control the restriction valve 4, co-operate with the piston control of the flow path from the air inlet to the respective transfer duct in order to provide the correct amount of air or gas at different engine speeds and loads. However, by means of a somewhat different tuning of the restriction valve control, the different, described control methods also ought to be able to co-operate with flow paths that are controlled by check valves.

What is claimed is:

1. A crankcase scavenged two-stroke internal combustion engine comprising:

a piston reciprocatingly arranged within a cylinder;

a flow path configured to selectively place an air inlet duct in fluid communication with a scavenging duct;

said air inlet duct being equipped with a restriction valve controlled by an engine parameter for controlling an amount of air permitted to pass through said air inlet duct;

said air inlet duct extending to an air inlet port formed in a cylinder wall of said engine and said scavenging duct extending from a scavenging port formed in said cylinder wall of said engine;

said air inlet port being positioned in said cylinder wall so that when said piston is positioned in a top dead center configuration, said air inlet duct is connected in fluid communication with said flow path;

said flow path being configured to extend from said air inlet duct to said scavenging duct when said piston is in said top dead center configuration so that a period of air supply through said air inlet duct to said engine is approximately as long as a period of fuel and air mixture supply to said engine during substantially each cycle of said two-stroke internal combustion engine; and an upper edge of said air inlet port is located at least as high in said cylinder's longitudinal axial direction as a lower edge of said scavenging port.

2. A crankcase scavenged two-stroke internal combustion engine comprising:

a piston reciprocatingly arranged within a cylinder;

a flow path configured to selectively place an air inlet port in fluid communication with a scavenging port, said flow path being at least partially formed in said piston and said air inlet port and said scavenging port being established at said cylinder; and said air inlet port and said scavenging port being located at substantially equal heights in said cylinder's longitudinal axial direction thereby establishing a longitudinally overlapping relationship in said cylinder's longitudinal axial direction between said air inlet port and said scavenging port.

3. A crankcase scavenged two-stroke internal combustion engine comprising:

a piston reciprocatingly arranged within a cylinder;

a flow path configured to selectively place an air inlet port in fluid communication with a scavenging port, said flow path being at least partially formed in said piston and said air inlet port and said scavenging port being established at said cylinder; and said air inlet port being arranged in said cylinder wall so that when said piston is in a bottom dead center configuration exhaust gases from said cylinder are permitted to penetrate into said air inlet port.

4. A crankcase scavenged two-stroke internal combustion engine comprising:

a piston reciprocatingly arranged within a cylinder;

a flow path configured to selectively place an air inlet port in fluid communication with a scavenging port, said flow path being at least partially formed in said piston and said air inlet port and said scavenging port being established at said cylinder; and an upper edge of said air inlet port being located at least as high in said cylinder's longitudinal axial direction as a lower edge of said scavenging port thereby establishing a longitudinally overlapping relationship in said cylinder's longitudinal axial direction between said air inlet port and said scavenging port.

5. The crankcase scavenged two-stroke internal combustion engine as recited in claim 4, further comprising:

said scavenging port is located substantially level with said air inlet port in said longitudinal axial direction of said cylinder.

6. The crankcase scavenged two-stroke internal combustion engine as recited in claim 4, further comprising:

said air inlet port being positioned sufficiently high in said cylinder wall that fluid communication is affected between said air inlet port and said flow path when said piston is positioned in an absolute top dead center configuration; and said scavenging port being positioned sufficiently high in said cylinder wall that fluid communication is affected between said scavenging port and said flow path when said piston is positioned in an absolute top dead center configuration thereby affecting fluid communication between said air inlet port and said scavenging port when said piston is positioned in an absolute top dead center configuration.

7. The crankcase scavenged two-stroke internal combustion engine as recited in claim 4, further comprising:

said flow path being configured to extend from said air inlet port to said scavenging port when said piston is in a top dead center configuration so that a period of air supply through said air inlet port to said engine is approximately as long as a period of fuel and air mixture supply to said engine during substantially each cycle of said two-stroke internal combustion engine.

8. The crankcase scavenged two-stroke internal combustion engine as recited in claim 4, further comprising:

an air inlet duct extending from said air inlet port through a wall of said cylinder, said air inlet duct being equipped with a restriction valve.

9. The crankcase scavenged two-stroke internal combustion engine as recited in claim 8, further comprising:

said restriction valve being in controlled communication with speed controls of said engine thereby enabling said restriction valve to be controlled by an engine parameter for controlling an amount of air permitted to pass through said air inlet duct.

10. The crankcase scavenged two-stroke internal combustion engine as recited in claim 4, further comprising:

said air inlet port, said scavenging port and said flow path being configured relative to one another so that fluid communication is established and continuously maintained one time only during each reciprocation cycle of said piston within said cylinder.

11. The crankcase scavenged two-stroke internal combustion engine as recited in claim 10, further comprising:

said air inlet port and said scavenging port being each positioned sufficiently high in said cylinder wall that fluid communication is maintained continuously therebetween when said piston is positioned in a top dead center configuration within said cylinder; and said scavenging port being positioned sufficiently high in said cylinder wall that fluid communication is affected between said scavenging port and said flow path when said piston is positioned in an absolute top dead center configuration thereby affecting fluid communication between said air inlet port and said scavenging port when said piston is positioned in an absolute top dead center configuration.

12. The crankcase scavenged two-stroke internal combustion engine as recited in claim 4, further comprising:

said flow path formed as a recess in said piston, said recess having a radially measurable portion that comes into registration with said air inlet port during reciprocation of said piston within said cylinder; and said recess having a maximum longitudinally measurable height across said radially measurable portion that is greater than approximately one and one-half times a maximum longitudinally measurable height of said air inlet port for enhancing scavenging efficiency of said engine

13. The crankcase scavenged two-stroke internal combustion engine as recited in claim 4, further comprising:

said air inlet port being located in said cylinder so that said piston closes said air inlet port when in a bottom dead center position.

14. The crankcase scavenged two-stroke internal combustion engine as recited in claim 13, further comprising:

an exhaust port and a fuel and air inlet port each being located in said cylinder, said exhaust port being located above said fuel and air inlet port in said cylinder's longitudinal direction;

said flow path being formed as a recess in a portion of said piston, said recess configured so that at least a portion of said recess comes into registration with said air inlet port when said piston is in a top dead center configuration thereby establishing fluid communication therebetween, and said piston being further configured so that no portion of said recess comes into registration with said exhaust port in said top dead center configuration; and an upper edge of said recess being located higher than a lower edge of said exhaust port with respect to said cylinder's longitudinal axial direction when said piston is in a top dead center configuration.

15. The crankcase scavenged two-stroke internal combustion engine as recited in claim 4, further comprising:

said air inlet port being arranged in said cylinder wall so that when said piston is in a bottom dead center configuration exhaust gases from said cylinder are permitted to penetrate into said air inlet.

16. The crankcase scavenged two-stroke internal combustion engine as recited in claim 4, further comprising:

an air inlet duct in fluid communication with said air inlet port and said air inlet duct being equipped with a restriction valve controlled by an engine parameter for controlling an amount of air permitted to pass through said air inlet duct;

said air inlet duct extending to said air inlet port formed in a cylinder wall of said engine and said scavenging duct extending from said scavenging port formed in said cylinder wall of said engine;

said air inlet port being positioned in said cylinder wall so that when said piston is positioned in a top dead center configuration, said inlet duct is thereby connected in fluid communication with said flow path; and said flow path being configured to extend from said air inlet duct to said scavenging duct when said piston is in said top dead center configuration so that a period of air supply through said air inlet duct to said engine is approximately as long as a period of fuel and air mixture supply to said engine during substantially each cycle of said two-stroke internal combustion engine.

17. The crankcase scavenged two-stroke internal combustion engine as recited in claim 16, wherein said period of air supply to said engine is essentially equal to said fuel and air mixture supply period, each of said periods being measurable based on crank angle.

18. The crankcase scavenged two-stroke internal combustion engine as recited in claim 15, wherein said period of air supply to said engine is essentially equal to said fuel and air mixture supply period, each of said periods being measurable based on time.

19. The crankcase scavenged two-stroke internal combustion engine as recited in claim 16, wherein said period of air supply to said engine is longer than said fuel and air mixture supply period, each of said periods being measurable based on crank angle.

20. The crankcase scavenged two-stroke internal combustion engine as recited in claim 16, wherein said period of air supply to said engine is longer than said fuel and air mixture supply period, each of said periods being measurable based on time.

21. The crankcase scavenged two-stroke internal combustion engine as recited in claim 16, wherein engine parameter is carburetor throttle control.

22. A crankcase scavenged two-stroke internal combustion engine as recited in claim 16, wherein said period of air supply is greater than about 90% of the fuel and air mixture supply period and less than about 110% of the fuel and air mixture period.

23. The crankcase scavenged two-stroke internal combustion engine as recited in claim 16, wherein said flow path further comprises a recess disposed in the periphery of said piston.

24. The crankcase scavenged two-stroke internal combustion engine as recited in claim 23, further comprising:

said flow path formed as a recess in said piston, said recess having a radially measurable portion that comes into registration with said air inlet port during reciprocation of said piston within said cylinder; and said recess having a maximum longitudinally measurable height across said radially measurable portion that is greater than approximately two times a maximum longitudinally measurable height of said air inlet port for enhancing scavenging efficiency of said engine.

25. The crankcase scavenged two-stoke internal combustion engine as recited in claim 16, further comprising:

said flow path formed as a recess in said piston, said recess having a radially measurable portion that comes into registration with said air inlet port during reciprocation of said piston within said cylinder; and said recess having a maximum longitudinally measurable height across said radially measurable portion that is greater than approximately two times a maximum longitudinally measurable height of said air inlet port for enhancing scavenging efficiency of said engine.

26. The crankcase scavenged two-stroke internal combustion engine as recited in claim 16, further comprising:

said flow path being at least partially arranged in the form of a duct within said piston.

27. The crankcase scavenged two-stroke internal combustion engine as recited in claim 16, further comprising:

said air inlet port being arranged in said cylinder wall so that said piston entirely covers said air inlet port when said piston is in a bottom dead center configuration.

28. The crankcase scavenged two-stroke internal combustion engine as recited in claim 16, further comprising:

said restriction valve being controlled by said engine's rotational speed so that said valve is essentially closed at an idling speed and open at rotational speeds exceeding a predetermined low rotational speed.

29. The crankcase scavenged two-stroke internal combustion engine as recited in claim 28, further comprising:

said restriction valve being controlled by a carburetor throttle valve position.

30. The crankcase scavenged two-stroke internal combustion engine as recited in claim 28, further comprising:

said restriction valve being controlled by an under-pressure condition in a fuel and air supply inlet tube.

31. The crankcase scavenged two-stroke internal combustion engine as recited in claim 16, further comprising:

said restriction valve being controlled by an under-pressure condition in a fuel and air supply inlet tube so that said restriction valve is essentially closed at idling and open at under-pressure conditions below a predetermined under-pressure value.

32. The crankcase scavenged two-stroke internal combustion engine as recited in claim 31, further comprising:

said restriction valve being additionally controlled by carburetor throttle valve position.

33. The crankcase scavenged two-stroke internal combustion engine as recited in claim 32, further comprising:

said restriction valve being additionally controlled by engine speed.

34. The crankcase scavenged two-stroke internal combustion engine as recited in claim 23, further comprising:

said restriction valve being additionally controlled by carburetor throttle valve position and engine speed.

35. A crankcase scavenged two-stroke internal combustion engine as recited in claim 32, further comprising:

said flow path being arranged entirely free of check valves from said air inlet to said scavenging duct.

36. A crankcase scavenged two-stroke internal combustion engine as recited in claim 16, further comprising:

said air inlet port being located essentially radially inside an adjacent scavenging duct and said air inlet port being positioned at least partly longitudinally below said scavenging port.

37. A crankcase scavenged two-stroke internal combustion engine comprising:

a piston reciprocatingly arranged within a cylinder;

a flow path configured to selectively place an air inlet duct in fluid communication with a scavenging duct;

said air inlet duct being equipped with a restriction valve controlled by an engine parameter for controlling an amount of air permitted to pass through said air inlet duct;

said air inlet duct extending to an air inlet port formed in a cylinder wall of said engine and said scavenging duct extending from a scavenging port formed in said cylinder wall of said engine;

said air inlet port being positioned in said cylinder wall so that when said piston is positioned in a top dead center configuration, said air inlet duct is thereby connected in fluid communication with said flow path;

said flow path being configured to extend from said air inlet duct to said scavenging duct when said piston is in said top dead center configuration so that a period of air supply through said air inlet duct to said engine is approximately as long as a period of fuel and air mixture supply to said engine during substantially each cycle of said two-stroke internal combustion engine; and an upper edge of said air inlet port is located at least as high in said cylinder's longitudinal axial direction as a lower edge of said scavenging port.

38. The crankcase scavenged two-stroke internal combustion engine as recited in claim 37, wherein said period of air supply to said engine is essentially equal to said fuel and air mixture supply period, each of said periods being measurable based on crank angle.

39. The crankcase scavenged two-stroke internal combustion engine as recited in claim 37, wherein said period of air supply to said engine is essentially equal to said fuel and air mixture supply period, each of said periods being measurable based on time.

40. The crankcase scavenged two-stroke internal combustion engine as recited in claim 37, wherein said period of air supply to said engine is longer than said fuel and air mixture supply period, each of said periods being measurable based on crank angle.

41. The crankcase scavenged two-stroke internal combustion engine as recited in claim 37, wherein said period of air supply to said engine is longer than said fuel and air mixture supply period, each of said periods being measurable based on time.

42. The crankcase scavenged two-stroke internal combustion engine as recited in claim 37, wherein said engine parameter is carburetor throttle control.

43. The crankcase scavenged two-stroke internal combustion engine as recited in claim 37, wherein said period of air supply is greater than about 90% of the fuel and air mixture supply period and less than about 110% of the fuel and air mixture period.

44. The crankcase scavenged two-stroke internal combustion engine as recited in claim 37, further comprising:

said restriction valve being controlled by said engine's rotational speed so that said valve is essentially closed at an idling speed and open at rotational speeds exceeding a predetermined low rotational speed.

45. The crankcase scavenged two-stroke internal combustion engine as recited in claim 44, further comprising:

said restriction valve being controlled by a carburetor throttle valve position.

46. The crankcase scavenged two-stroke internal combustion engine as recited in claim 44, further comprising:

said restriction valve being controlled by an under-pressure condition in a fuel and air supply inlet tube.

47. The crankcase scavenged two-stroke internal combustion engine as recited in claim 37, further comprising:

said restriction valve being controlled by an under-pressure condition in a fuel and air supply inlet tube so that said restriction valve is essentially closed at idling and open at under-pressure conditions below a predetermined under-pressure value.

48. The crankcase scavenged two-stroke internal combustion engine as recited in claim 47, further comprising:

said restriction valve being additionally controlled by carburetor throttle valve position.

49. The crankcase scavenged two-stroke internal combustion engine as recited in claim 48, further comprising:

said restriction valve being additionally controlled by engine speed.

50. The crankcase scavenged two-stroke internal combustion engine as recited in claim 48, further comprising:

said restriction valve being additionally controlled by carburetor throttle valve position and engine speed.

* * * * *

UNITED STATES PATENT AND TRADEMARK OFFICE

CERTIFICATE OF CORRECTION

PATENT NO. : 7,025,021 B1
APPLICATION NO. : 09/483478
DATED : April 11, 2006
INVENTOR(S) : Lars Andersson et al.

It is certified that error appears in the above-identified patent and that said Letters Patent is hereby corrected as shown below:

On title page
Item (22), please correct the Filed date of the present Application to read:
January 14, 2000

Signed and Sealed this

Eighteenth Day of July, 2006

JON W. DUDAS
*Director of the United States Patent and Trademark Office*

UNITED STATES PATENT AND TRADEMARK OFFICE

CERTIFICATE OF CORRECTION

PATENT NO. : 7,025,021 B1
APPLICATION NO. : 09/483478
DATED : April 11, 2006
INVENTOR(S) : Lars Andersson et al.

It is certified that error appears in the above-identified patent and that said Letters Patent is hereby corrected as shown below:

On Title Page Item (22), please correct the Filed date of the present Application to read: January 14, 2000

Signed and Sealed this

Eighteenth Day of November, 2008

JON W. DUDAS
*Director of the United States Patent and Trademark Office*